US010837197B2

(12) United States Patent
Kightlinger

(10) Patent No.: US 10,837,197 B2
(45) Date of Patent: Nov. 17, 2020

(54) HANDLE FOR DOOR CLOSING

(71) Applicant: Christopher Kightlinger, Sun City, CA (US)

(72) Inventor: Christopher Kightlinger, Sun City, CA (US)

( * ) Notice: Subject to any disclaimer, the term of this patent is extended or adjusted under 35 U.S.C. 154(b) by 0 days.

(21) Appl. No.: 16/442,315

(22) Filed: Jun. 14, 2019

(65) Prior Publication Data

US 2019/0390476 A1 Dec. 26, 2019

Related U.S. Application Data

(60) Provisional application No. 62/689,591, filed on Jun. 25, 2018.

(51) Int. Cl.
*E05B 1/00* (2006.01)

(52) U.S. Cl.
CPC ..... *E05B 1/0053* (2013.01)

(58) Field of Classification Search
CPC ... Y10T 16/458; Y10T 16/462; Y10T 16/464; Y10T 16/473; E05B 1/0053; E05B 85/107; E05B 5/00; E05B 5/003
See application file for complete search history.

(56) References Cited

U.S. PATENT DOCUMENTS 1,995,338 A * 3/1935 Andrews ..... E05B 85/22 70/489
2,245,899 A 6/1941 Campbell
2,586,986 A 2/1952 Orrison
2,599,054 A * 6/1952 Gates ..... E05B 5/003 292/348
3,082,473 A * 3/1963 West ..... A45C 13/26 16/445
3,388,416 A * 6/1968 Szabo ..... H04N 5/64 16/405
3,562,849 A * 2/1971 Brayshaw ..... A47B 95/02 16/445
3,572,870 A * 3/1971 Marks ..... A45C 13/22 312/244
4,494,784 A 1/1985 Haynes
(Continued)

FOREIGN PATENT DOCUMENTS

DE 4210588 A1 * 10/1993 ..... E05B 17/186
EP 2202368 A1 * 6/2010 ..... E05B 65/08
JP 2011047108 A * 3/2011

*Primary Examiner* — Chuck Y Mah
(74) *Attorney, Agent, or Firm* — Kirk A. Buhler; Buhler & Associates Patenting

(57) ABSTRACT

Improvements handle for door closing is disclosed. The handle is rotatable from an outer housing that both protects the handle and provides a structural frame for mounting the handle to a pre-existing door. A typical installation is to place the handle closer to the hinge side of the door. This allows a user to require a shorter reach and pull to the door. Because opening a door for a wheelchair requires the door to almost be completely opened. The handle also has a rotation stop that prevents the handle from being rotated out of the housing more than 90 degrees. A retention and extending mechanism both holds the handle within the housing and slightly opens the handle for a user to grasp. The housing can be surface mount or flush mount. The handle can allow for weight bearing support of a user.

16 Claims, 5 Drawing Sheets

(56) References Cited

U.S. PATENT DOCUMENTS

| | | | | | |
|---|---|---|---|---|---|
| 4,589,162 | A | * | 5/1986 | Manz | H05K 5/023 16/429 |
| 5,172,520 | A | * | 12/1992 | Hostetler | E05B 65/0841 292/207 |
| 5,314,221 | A | | 5/1994 | Hammer | |
| 5,425,155 | A | | 6/1995 | Marciniak | |
| 5,465,462 | A | * | 11/1995 | Yamada | E05B 5/003 16/429 |
| 5,540,468 | A | | 7/1996 | Fassman | |
| 5,556,145 | A | * | 9/1996 | Takasaki | E05B 5/00 292/336.3 |
| 5,638,709 | A | * | 6/1997 | Clavin | E05B 13/002 292/229 |
| 6,032,334 | A | * | 3/2000 | Iima | A45C 13/22 16/405 |
| 6,089,625 | A | * | 7/2000 | Prevot | E05B 65/087 292/140 |
| 6,340,189 | B1 | | 1/2002 | Pordy | |
| 6,799,353 | B1 | | 10/2004 | Stewart | |
| 7,182,374 | B2 | * | 2/2007 | Figge | B60R 5/04 292/334 |
| 7,261,344 | B1 | | 8/2007 | Drake, Jr. et al. | |
| 7,938,464 | B1 | | 5/2011 | Hielm | |
| 8,646,819 | B2 | * | 2/2014 | Do | E05B 17/22 292/228 |
| 9,062,474 | B2 | * | 6/2015 | Ibrahim | E05B 7/00 |

* cited by examiner

HANDLE FOR DOOR CLOSING

CROSS REFERENCE TO RELATED APPLICATIONS

This application claims the benefit of Provisional Application Ser. No. 62/689,591 filed Jun. 25, 2018 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a handle. More particularly, the present handle can be surface mounted or recessed into a door to allow a person to close an open door. This is particularly useful to a person in a wheelchair or for other people that need assistance.

Description of Related Art including information disclosed under 37 CFR 1.97 and 1.98.

An ambulatory person can simply pull a door shut behind them and walk out of the way of the swinging door. For people in wheelchair or with a walking device the ability to close a door is difficult because the wheelchair occupies the area of the door. The smooth flat surface of a door makes it difficult to grasp anything other than the knob to pull the door shut. Some people have secured ropes or other flexible members to the door to pull the door shut behind themselves. This leaves a rope hanging from the door that can be unsightly. Other people in wheelchairs use a cane to hook around the doorknob to pull the door shut. This requires a person to carry the cane and store it when not in use.

A number of patents and or publications have been made to address these issues. Exemplary examples of patents and or publication that try to address this/these problem(s) are identified and discussed below.

U.S. Pat. No. 5,314,221 issued on May 24, 1994 to Nicholas A. Hammer is titled Apparatus for aiding persons, particularly handicapped persons, in moving unreachable objects. This patent disclose a ball and socket arrangement for aiding the handicapped or persons having limited reach or mobility and including one of a plurality of socket elements secured to an object which is to be moved and which is engageable by means of a manually grippable wand including an elongated handle having a ball at one end which is adapted to engage the socket to apply either a pulling or a pushing force. In this patent the socket is secured to the object and he person carries the stick with the ball.

U.S. Pat. No. 5,425,155 issued on Jun. 20, 1995 to David S. Marciniak is titled Door opening device for wheelchair-bound persons. This patent discloses a substantially L-shaped grasping bar is hingedly attached to the hinge stile and the latch stile of a door. An upper surface of the latch stile attachment is placed adjacent the underside of the latch handle so that upon lifting the grasping bar, the latch is activated and the door can be easily manipulated by a wheelchair-bound person. The bar extends across the majority of the door and can't be blended or recessed into the door.

U.S. Pat. No. 7,261,344 issued on Aug. 28, 2007 to William Drake Jr. et al., is titled Doorman. This patent discloses an apparatus for assisting handicapped people in opening doors. The apparatus is used primarily for individuals in wheelchairs, who typically have difficulty in opening doors. The apparatus has a long shaft with two ends, and has a handle attached to one end of the shaft. The other end of the shaft has both a wedge and a pull pin attached to it. The doorman does not stay with the door, it is carried with the person on a wheelchair.

What is needed is a handle for door closing that can be extended or enclosed from within a housing. The housing can either be surface mounted or recessed within the door. The proposed handle for door closing provides a solution that can be easily opened and closed by a person in a wheelchair or when desired.

BRIEF SUMMARY OF THE INVENTION

It is an object of the handle for door closing to be positioned at any height or location on a door. Each user may need or have a desired location based on the preferred location and mechanical advantage they would like on the door. A typical installation is to place the handle closer to the hinge side of the door. This allows a user to require a shorter reach and pull to the door. Because opening a door for a wheelchair or walker requires the door to almost be completely opened. This places the door knob about three feet away from the doorway and would require a long reach to grasp the knob.

It is an object of the handle for door closing for the handle to be foldable into the housing. This allows the handle to be safely stored in the housing so the opening of the doorway is not restricted by the extended handle. The handle also has a rotation stop that prevents the handle from being rotated out of the housing more than 90 degrees. This places the handle perpendicular to the door face and makes it easier to pull the door shut and then fold the handle back into the housing.

It is another object of the handle for door closing for the housing to have a mechanism that pushes one end out of the housing. With the handle flush to the housing it can be difficult for the user to grasp or pull-out the handle. The mechanism slightly pivots the handle out of the housing to allow a user to further rotate the handle out of the housing where the handle can be completely extended for use. After use, the handle can then be rotated back into the housing where it is retained flush within the housing. There are various different configurations for the mechanism where each mechanism has different benefits for cost and performance.

It is another object of the handle for door closing for the handle to be weight supporting. The weight supporting ability allows a user to use the handle on a completely close or completely opened door to push, pull or lift on the handle to assist the user to stand-up or re-position their weight or to steady themselves while closing the door. After use the handle can be pushed closed within the housing.

It is still another object of the handle for door closing for the housing to be mountable as either a surface mount where the housing and handle is on the outer surface of the door. The housing and handle can then be removed from the surface of the door with minimal surface damage to the door. The housing can also be configured as a flush mount where a pocket is made in the door and the housing and handle are recessed into the outer surface of the door. This will result in a smooth outer surface on the door and provides the stated benefits to the handle for door closing. In nearly all cases the housing is installed on a solid core door that will accept the mechanical stresses. The housing can also be mounted with hardware that extends through the door where it is secured with nuts or other hardware on the opposing side of the door.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
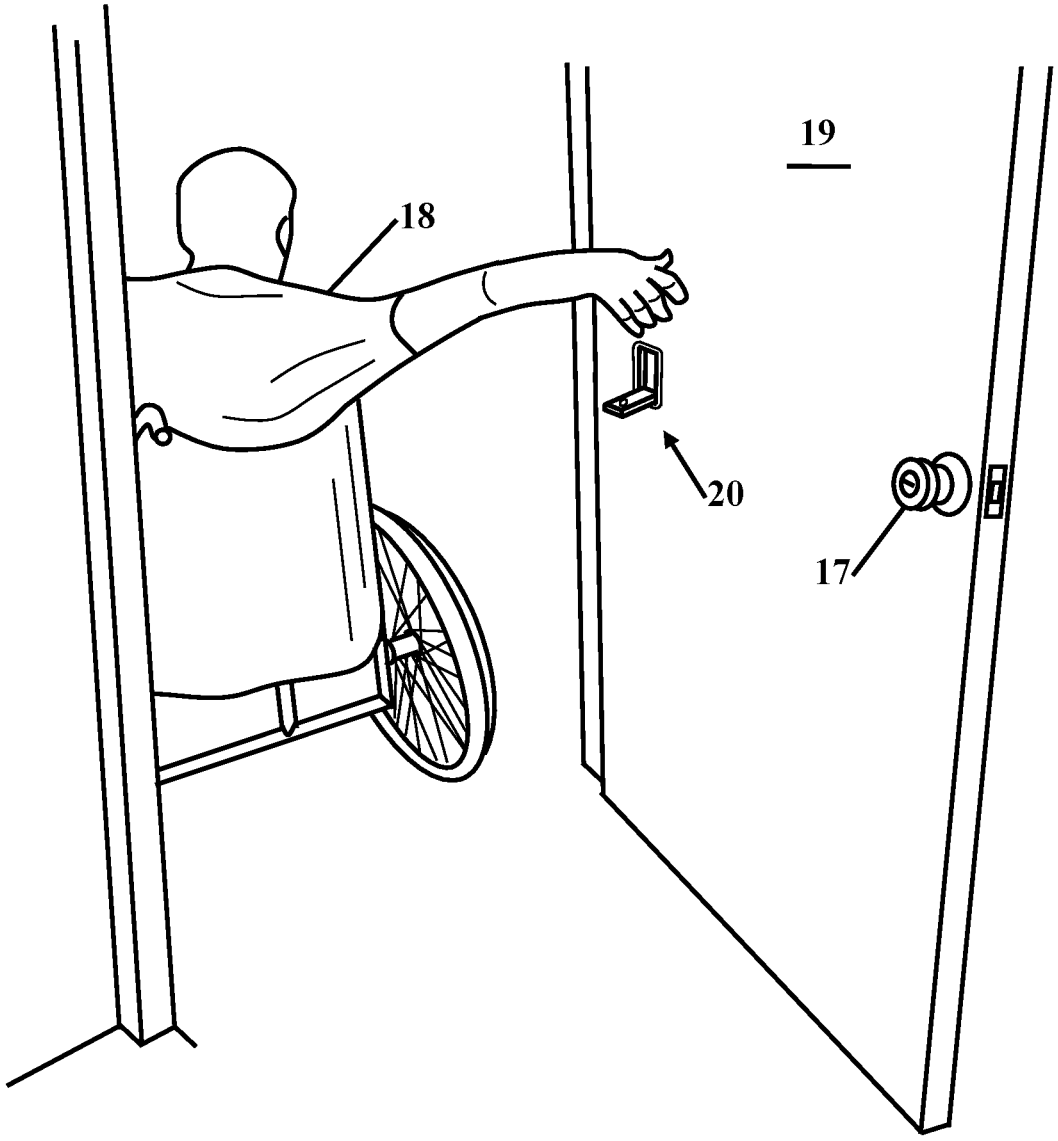
FIG. 1 shows a handle for door closing in an environment of use.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

Item Numbers and Description

17 door knob
18 person in wheelchair
19 door
20 handle for door closing
21 handle for door closing
22 handle for door closing
40 face surface
41 lip
42 pocket
43 rotation stop surface
44 screw hole
45 outer recess
50 magnetic pusher
51 pusher stud
60 handle
61 pocket
62 rotational axle
63 roll pin
64 lock recess
70 outer housing
71 spring
72 pivoting latch
73 latch tab
74 roll pin
75 spring
78 pin
79 spring
80 outer housing
81 latch
82 front housing
83 recess pocket
84 slide housing
85 slide tab
86 handle FIG. 1 shows a handle for door closing 20 in an environment of use. This figure shows a typical use where the person 18 in the wheelchair has passed through the doorway and is essentially clear of the door 19 swing. The knob 17 for the door 19 is clearly out-of-reach for the person 18 in the wheelchair. The handle 20 is placed closer to the hinge of the door 19 and can be easily reached to grasp and pull the door closed. The handle 20 on the door 19 is restricted from rotating beyond about 90 degrees to prevent pinching the fingers or hand and to provide support. With the handle 20 essentially perpendicular to the door 19 the person 18 can essentially pull the handle 20/door 19 straight towards them at an optimal force. After the door 19 has been closed the handle 20 can be rotated into the housing and essentially parallel to the outer surface of the door 19.

Figure 2:
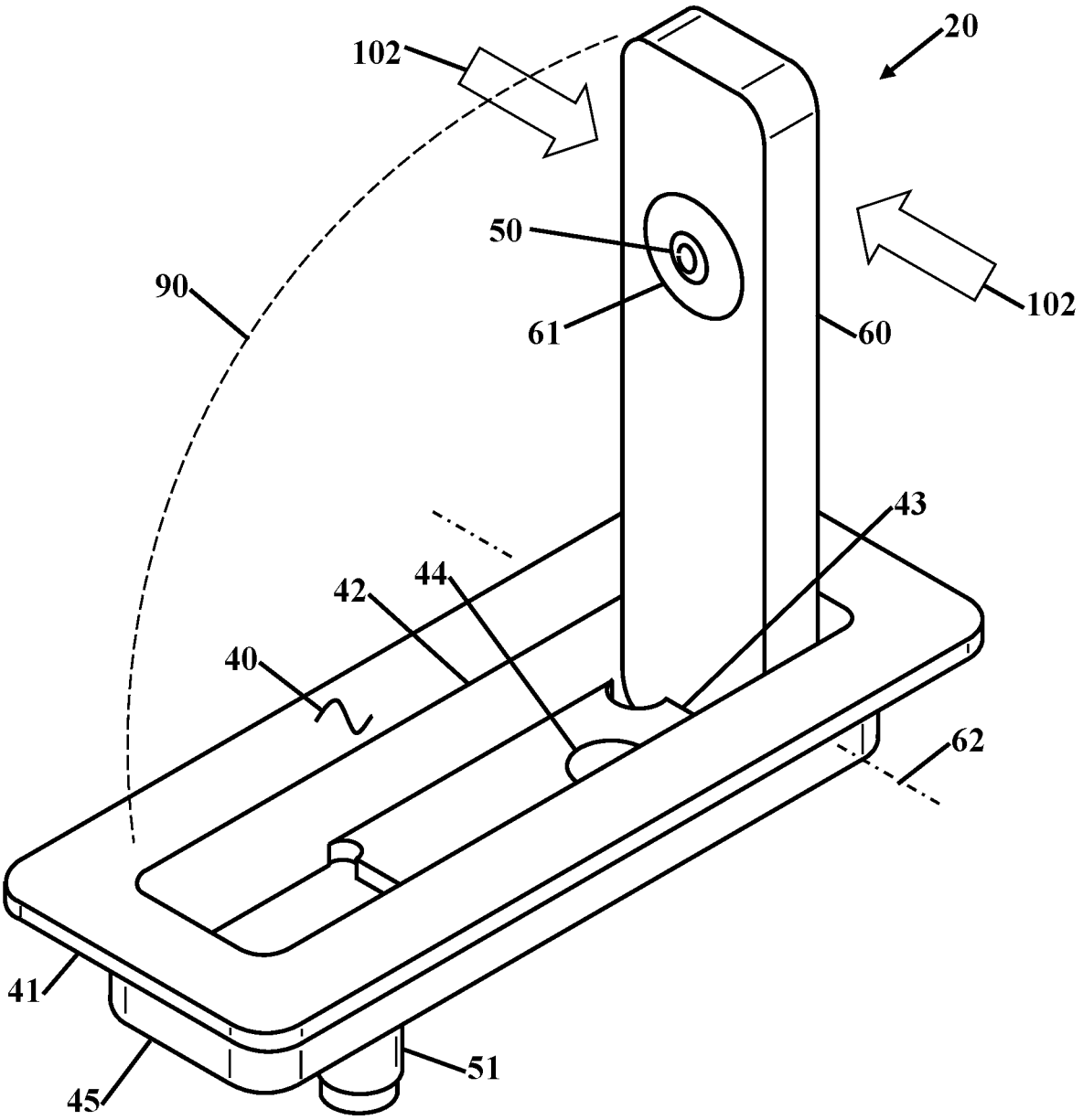
FIG. 2 shows a handle for door closing in a first preferred embodiment.

FIG. 2 shows a handle for door closing 20 in a first preferred embodiment. This figure shows the handle 60 extended from the body of the handle for closing a door 20. The handle 60 fits within the pocket 42 which allows the handle 60 fit flush with the face surface 40 The handle for a door 20 is secured and retained in a door with screws or other hardware by being placed through screw hole 44. The handle 60 pivots from the body through rotational axle 62 and the rotational arc 90 is shown. In this embodiment the handle for a door 20 is configured for flush mounting into a door.

To mount the handle for a door 20 into a pre-existing door a pocket must be cut into the door to accommodate the outer recess 45. An additional pocket can be milled into a door to accommodate the lip 41. Once the handle for a door 20 is placed into a door the entire top surface of the handle for a door 20 is flush, to allow a user to grasp the handle 60 it must be at least slightly extended from the face surface 40. A magnetic clasp retains the handle 60 within the pocket 42. To obtain an edge of the handle 60 to lower the handle 60, a user pushes the handle 60 down into the housing. The magnetic pusher 51 extends the portion of the handle 60 from the surrounding face surface 40. The bottom of the magnetic pusher 51 extends behind the housing with a pusher stud 51 that further extends into the door. This provides an edge of the handle 60 to fully deploy the handle 60 by following the rotational arc 90.

Within the pocket 42 there is a rotational stop surface 43 that prevents over-rotation of the handle 60. The rotation 90 of the handle from the housing is essentially 90 degrees, but other angles are contemplated to nearly 150 or more degrees.

The handle 60 is secured to the body with a pin, a roll pin, or other member that provides equivalent function. The roll pin provides sufficient strength to use the handle as a support to assist in lifting or supporting body weight and from side loads 102 on the handle 60 to move the door 19. After use the handle 60 is rotated 90 degrees back into the housing where the magnet portion of the magnetic pusher 51 nests within the pocket 61 with the metal plate inside and secured with a press-fit or with an adhesive such as epoxy.

Figure 3:
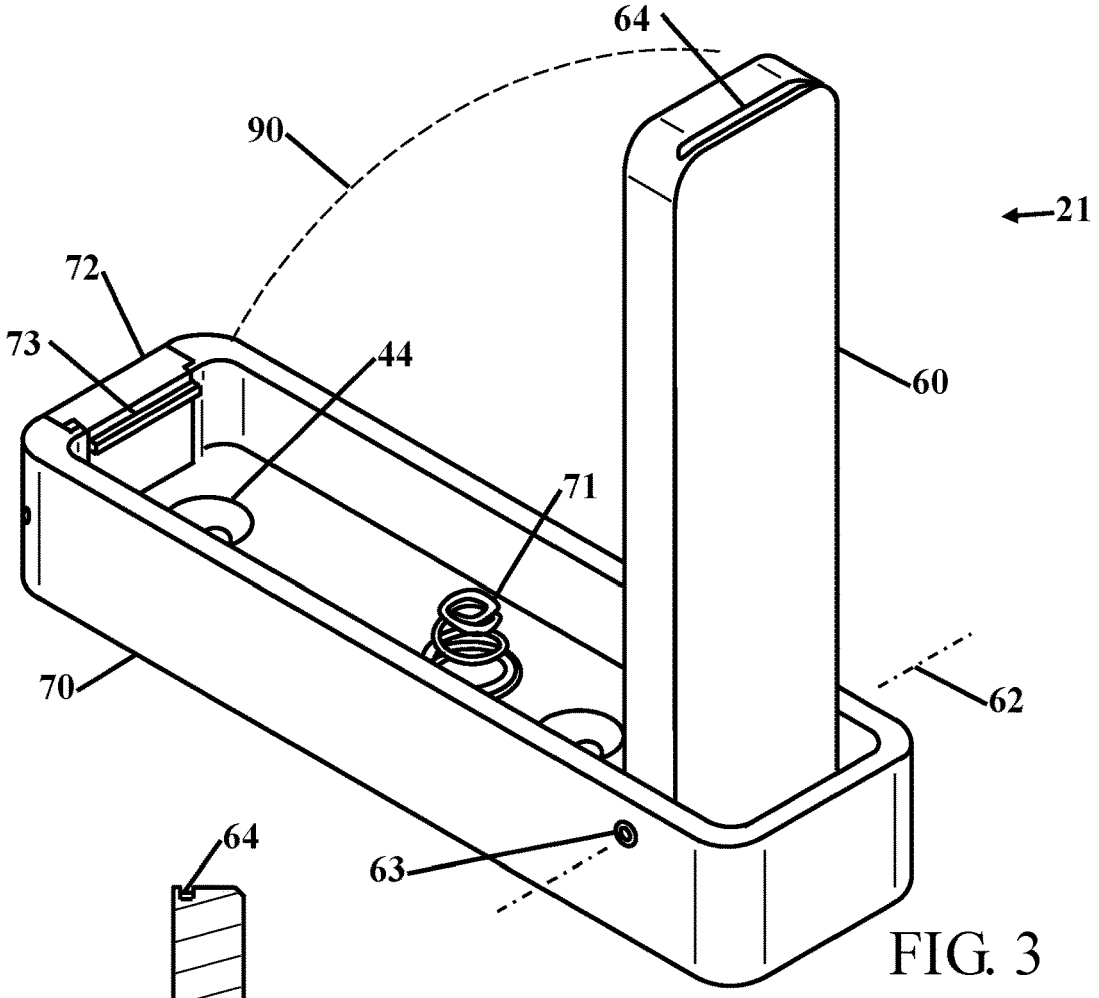
FIG. 3 shows a handle for door closing in a second preferred embodiment.
Figure 4:
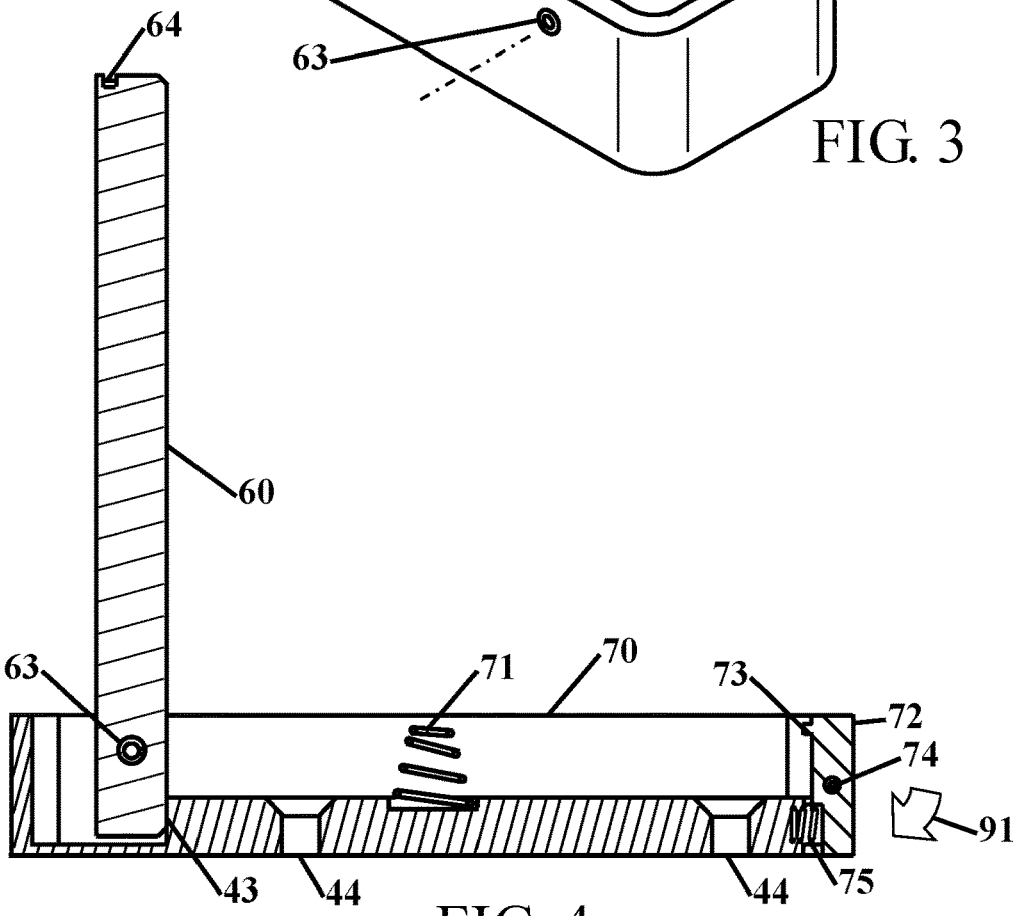
FIG. 4 shows a side sectional view of the second embodiment.

FIG. 3 shows a handle for door closing 21 in a second preferred embodiment and FIG. 4 shows a side sectional view of the second embodiment. This second embodiment is similar to the previous version shown and described. In this second preferred embodiment the handle for a door 21 is configured for mounting on an exterior surface of a door. There is no exterior lip to limit how far the body of the handle for a door 21 is placed into a door, but the handle for a door 21 can be placed into a milled or routed recess or pocket. The handle for a door 21 is mounted on the door with fasteners or screws placed through the screw holes 44. The roll pin 63 is shown passing through the side of the outer housing 70 and the handle 60. This allows for rotation of the handle 60 as the handle follows the rotation arc 90 and pivots on rotation axle 62. At the end of the travel of the handle 60 the bottom of the handle 60 is shown contacting the rotation stop surface 43 that limits further rotation of the handle 60.

Within the housing is a pocket with a spring 71 that pushes the handle 60 out of the housing. The handle 60 is retained flush with the housing with a latch tab 73 that engages in a lock recess 64 on the end of the handle 60. The latch tab 73 is on a pivoting latch 72. The pivoting latch 72 is maintained in position with a biasing spring 75. The pivoting latch 72 pivots on roll pin 74. A user presses on the bottom of the pivoting latch 72 to rotate 91 the latch. The rotation 91 of the latch 72 will pull the latch tab 73 from the lock recess 64. The spring 71 will then push one end of the handle 60 out of the outer housing. A user can then lift the end of the handle 60 and pull on the handle 60 to pull a door closed. After user, the user can push on the handle 60 to rotate the handle 60 into the housing. The end of the handle 60 is sloped to push open the pivoting latch and the lock recess 64 will fall into the latch tab 73 to retain the handle 60 in the closed condition where the outer surface of the handle 60 is flush with the face surface of the housing.

Figure 6:
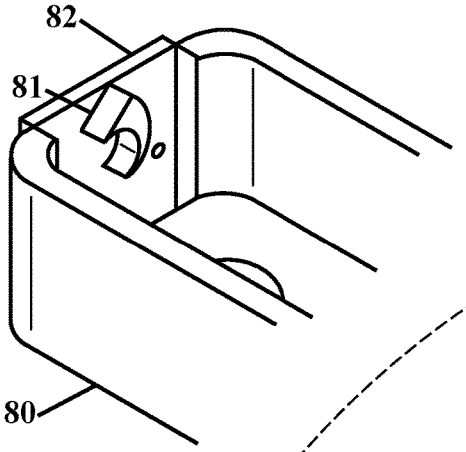
FIG. 6 shows a detail of the latch.
Figure 7:
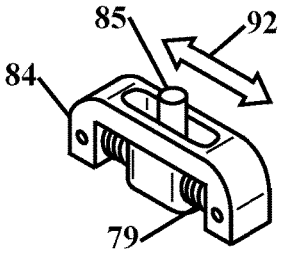
FIG. 7 shows a detail of the tab mechanism.
Figure 5:
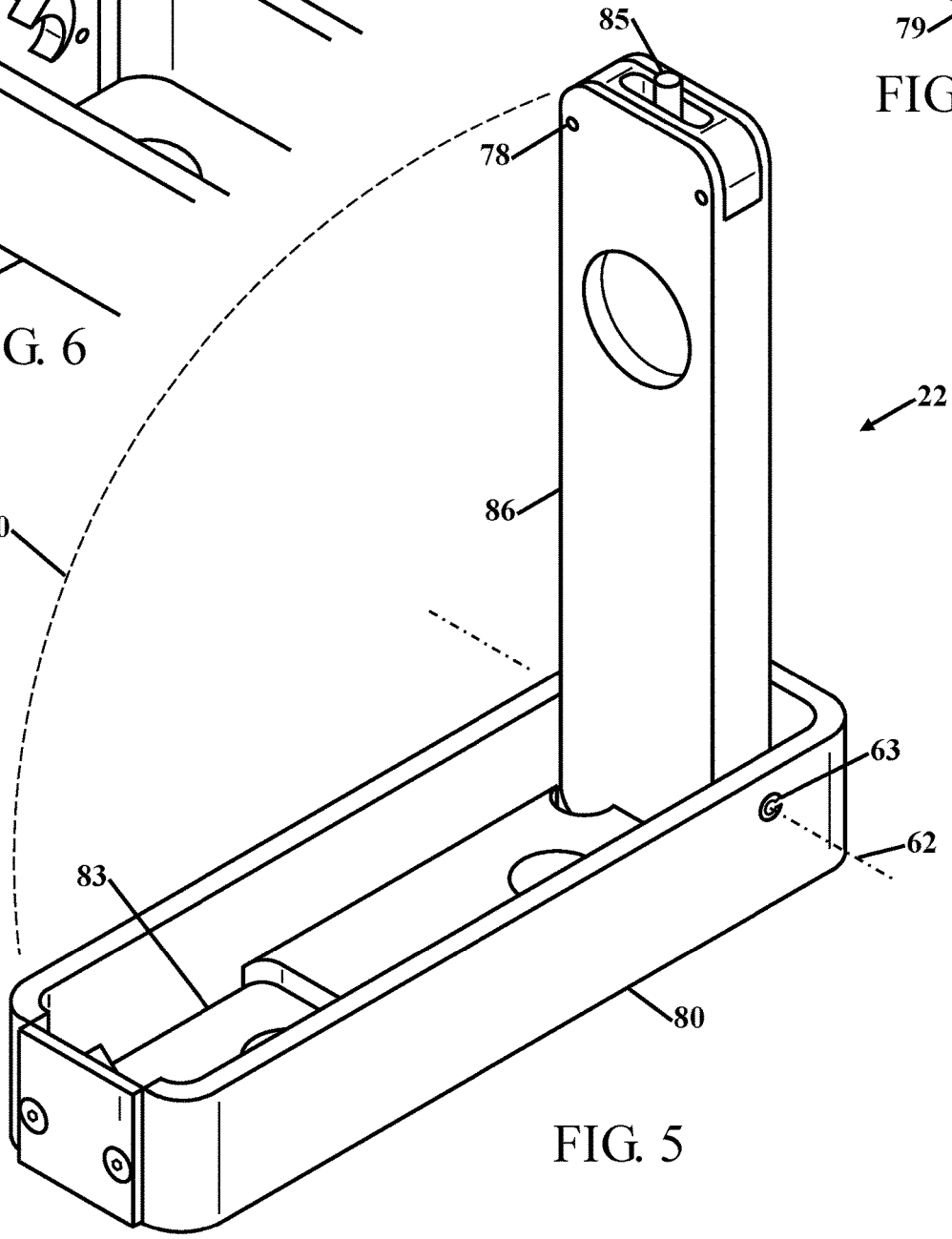
FIG. 5 shows a handle for door closing in a third preferred embodiment.

FIG. 5 shows a handle for door 22 closing in a third preferred embodiment, FIG. 6 shows a detail of the latch 81 and FIG. 7 shows a detail of the slide tab 85 mechanism. The handle 86 rotates from the outer housing 80 with a roll pin 63 or similar mechanism on rotational axle or axis 62. This allows the handle 86 to sing in the rotation arc 90. This third preferred embodiment is similar to the second preferred embodiment with the differences being the mechanism that retains the handle 86 within the outer housing 80.

This embodiment of the handle for door 22 allows the handle for door 22 to be recessed into a door and does not require access to the from of the housing to release the handle 86. A user can press on the top of the handle 86 to eject the front edge of the handle 86 and can push the handle 86 back into the housing to secure and store the handle 86. In the first embodiment 20 the magnetic retention mechanism extended beyond the bottom of the housing, whereas in this embodiment of the handle for door 22 the portion of the retention and rejecting mechanism is integrated with the handle 86 and in the front of the outer housing 80.

FIG. 7 shows a detail of the slide tab 85. The slide tab 85 is restrained in a housing with two springs 79 that center the slide tab 85 within the slide housing 84. The slide tab 85 can be pushed side-to-side 92 within the slide housing 84 and the springs 79 will center the slide tab 85 in the slide housing 84 as shown in FIG. 5. The mechanism is configured to be inserted into a slot in the handle 86 where it is retained with pins 78 or other securing hardware. FIG. 8 shows a detail of the latch 81 where the slide tab 85 engages and interacts.

The latch is integrated or formed on the front hosing 82. The latch 81 has two integrated moon shapes where the slide tab 85 slides around the latch 81 to retain and eject the slide tab 85 to hole the handle 86 within the outer housing 80. While the latch 81 is shown proud from the front housing 82 it is also contemplated that the latch 81 can be recessed to provide the path for the slide tab to follow. The operation of the latching mechanism is shown and described in other figures herein.

Figure 8A:
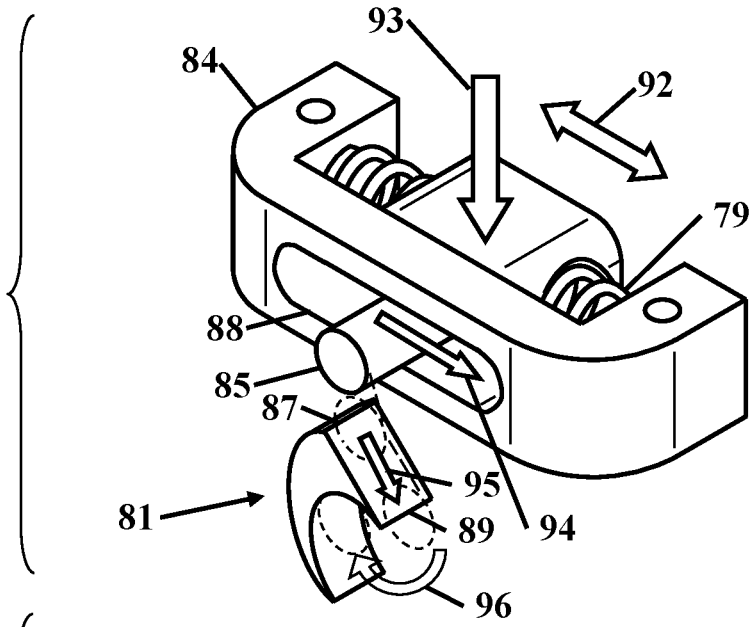
FIG. 8A-8C shows the operation of the latch.
Figure 8B:
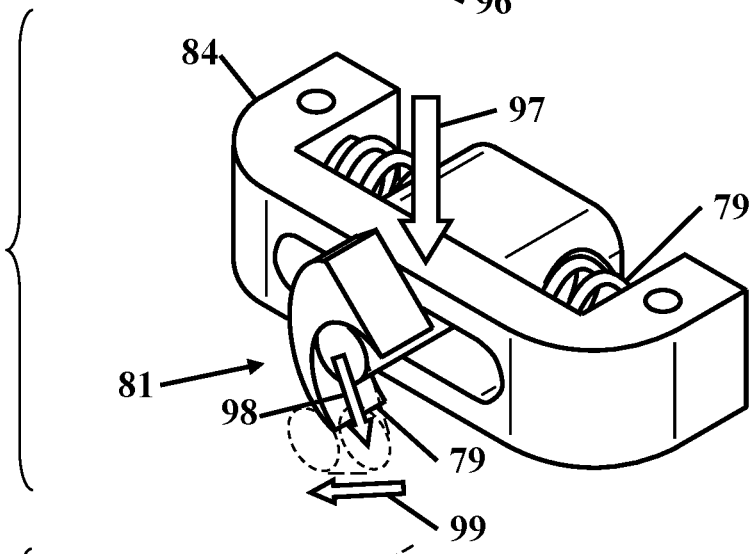
Figure 8C:
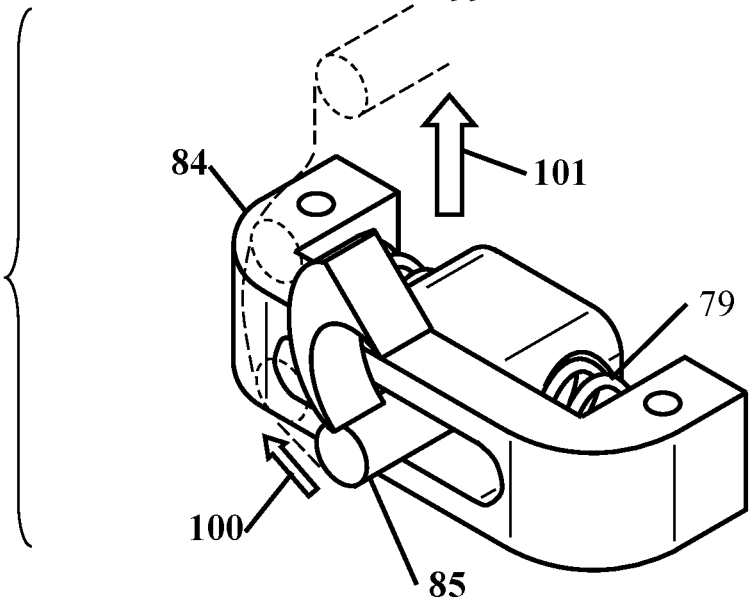

FIG. 8A-8C shows the operation of the latch. As previously described the slide tab 85 can move side-to-side 92 within the slide housing 84. In FIG. 8A the slide tab 85 on the handle 86 (not shown) is being brought down 93 into the latch 81. The slide tab 85 is centered in the slide housing 84 with springs 79. As the slide tab 85 is brought down 93 into the latch 81, the slide tab 85 will slide down the right side of the top edge 87. This will push the slide tab 85 across 94, within the slot 88. The slide tab 85 will be pushed across 94 until the slide tab 85 reaches the bottom edge 89 of the latch 81. At this point, the spring 79 will push the slide tab 85 to slide under the latch 81. When the downward force 93 is no longer applied the underside of the latch 81 will retain the slide tab 85 in a closed position where the handle is flush with the top surface of the outer housing.

Referring back to FIG. 5, there is a recess pocket 83 that allows the leading edge of the handle 86 to be pressed into the outer housing. In FIG. 8B this motion is shown and described with the down 97 force. This force will cause the slide tab 85 to slide down 98 the face of the latch 81 where the slide tab 85 will move across 99 the latch and under the bottom edge of the latch 81. The spring will then re-center the slide tab 85 and will push the slide tab 85 around 100 the latch 81 as shown in FIG. 8C and will push the slide tab 85 (and the handle 86) up 101 to expose the front edge of the handle (not shown). The entire sequence can then be repeated to use and store the handle within the outer housing.

Thus, specific embodiments of a handle for door closing have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A handle for door closing comprising:

an outer housing;

a handle that pivots from said outer housing;

wherein a first end of said handle has a pivot where said handle pivots from said housing and a second end of said handle has a pin that extends from said second end;

a rotation stop that limits rotation of said handle from said outer housing;

a retention mechanism that retains said handle in a flush configuration with said housing, and an ejection mechanism that produces a limited rotation of said handle from being flush with said housing.

2. The handle for door closing according to claim 1, wherein said housing is configured to flush mount to a pre-existing entry door.

3. The handle for door closing according to claim 1, wherein said housing is configured to surface mount on an outside surface of a pre-existing entry door.

4. The handle for door closing according to claim 1, wherein said handle is constrained to rotate within a range of 0 to 90 degrees from said housing.

5. The handle for door closing according to claim 1, wherein a first push of said handle into said housing locks handle into said housing.

6. The handle for door closing according to claim 5, wherein a second push of said handle ejects said handle from said housing using said ejection mechanism.

7. The handle for door closing according to claim 1, wherein said pin is centered in said handle with springs on opposing sides of said pin.

8. The handle for door closing according to claim 7, wherein said housing has a moon shaped latch.

9. The handle for door closing according to claim 8, wherein said moon shaped latch further includes a top edge that is offset from center.

10. The handle for door closing according to claim 9, wherein said pin interacts with said moon-shaped latch.

11. The handle for door closing according to claim 10, wherein said interaction is by said pin being retained within an arc of said moon-shaped latch.

12. The handle for door closing according to claim 11, wherein said moon-shaped latch operates with at least one of said springs on said pin to eject sad handle from said housing.

13. The handle for door closing according to claim 1, wherein an inside bottom surface of said housing is recessed to allow said second end of said handle to rotate past flush with a top surface of said housing.

14. The handle for door closing according to claim 1, wherein said housing includes at least one hole for a fastener.

15. The handle for door closing according to claim 14, wherein said fastener is configured to secure said housing to a door.

16. The handle for door closing according to claim 15, wherein said handle for door closing is configured to surface mount on said door or in a recessed pocket of said door.

* * * * *